US010870805B2

(12) United States Patent
Choi et al.

(10) Patent No.: US 10,870,805 B2
(45) Date of Patent: Dec. 22, 2020

(54) REMOVAL OF OLEFINS FROM HYDROTHERMALLY UPGRADED HEAVY OIL

(71) Applicant: Saudi Arabian Oil Company, Dhahran (SA)

(72) Inventors: Ki-Hyouk Choi, Dhahran (SA); Muneef F. Alqarzouh, Dhahran (SA)

(73) Assignee: SAUDI ARABIAN OIL COMPANY

( * ) Notice: Subject to any disclaimer, the term of this patent is extended or adjusted under 35 U.S.C. 154(b) by 101 days.

(21) Appl. No.: 15/893,961

(22) Filed: Feb. 12, 2018

(65) Prior Publication Data

US 2019/0249096 A1 Aug. 15, 2019

(51) Int. Cl.
*C10G 69/00* (2006.01)
*C10G 69/02* (2006.01)
(Continued)

(52) U.S. Cl.
CPC ..... *C10G 69/02* (2013.01); *C10G 9/00* (2013.01); *C10G 31/06* (2013.01); *C10G 31/08* (2013.01);
(Continued)

(58) Field of Classification Search
CPC ..... C10G 9/00; C10G 31/06; C10G 31/08; C10G 53/02; C10G 53/04; C10G 55/04;
(Continued)

(56) References Cited

U.S. PATENT DOCUMENTS 1,907,317 A * 5/1933 Brown ..... C07B 35/06 568/694
4,483,761 A 11/1984 Paspek, Jr.
(Continued)

OTHER PUBLICATIONS

Invitation to pay additional fees and, where applicable, protest fee dated May 27, 2019.
(Continued)

*Primary Examiner* — Prem C Singh
*Assistant Examiner* — Brandi M Doyle
(74) *Attorney, Agent, or Firm* — Bracewell LLP; Constance G. Rhebergen

(57) ABSTRACT

A method for sulfur removal and upgrading comprising the steps of mixing a heated oil feed and a supercritical water feed in a feed mixer, allowing conversion reactions to occur in the supercritical water reactor, reducing the temperature in the cooling device to produce a cooled fluid, reducing the pressure in the depressurizing device to produce a discharged fluid, separating the discharged fluid in the gas-liquid separator to produce a liquid phase product, increasing the pressure to produce pressurized liquid product, the pressure of pressurized liquid product is greater than the critical pressure of water, processing the pressurized liquid product in the hydration reactor to produce a hydrated oil stream, separating the hydrated oil stream to produce an extracted upgraded oil and an oxygenate concentrated stream, the oxygenate concentrated stream comprises the oxygenates, and processing the extracted upgraded oil in the hydrotreater to produce a desulfurized upgraded oil.

13 Claims, 5 Drawing Sheets

(51) Int. Cl.

| | |
|---|---|
| ***C10G 9/00*** | (2006.01) |
| ***C10G 53/04*** | (2006.01) |
| ***C10G 67/04*** | (2006.01) |
| ***C10G 53/02*** | (2006.01) |
| ***C10G 69/06*** | (2006.01) |
| ***C10G 67/02*** | (2006.01) |
| ***C10G 31/06*** | (2006.01) |
| ***C10G 55/04*** | (2006.01) |
| ***C10G 31/08*** | (2006.01) |

(52) U.S. Cl.
CPC ..... *C10G 53/02* (2013.01); *C10G 53/04* (2013.01); *C10G 55/04* (2013.01); *C10G 67/02* (2013.01); *C10G 67/04* (2013.01); *C10G 69/06* (2013.01); *C10G 2300/202* (2013.01)

(58) Field of Classification Search
CPC ..... C10G 67/02; C10G 67/04; C10G 69/02; C10G 69/06
See application file for complete search history.

(56) References Cited

U.S. PATENT DOCUMENTS

| | | | | |
|---|---|---|---|---|
| 4,795,550 | A | 1/1989 | Sachtler et al. | |
| 5,078,751 | A * | 1/1992 | Mizrahi | C10L 1/023 44/448 |
| 5,405,814 | A | 4/1995 | Beech, Jr. et al. | |
| 5,824,214 | A | 10/1998 | Paul et al. | |
| 6,602,405 | B2 | 8/2003 | Pradhan et al. | |
| 7,144,498 | B2 | 12/2006 | McCall et al. | |
| 7,431,827 | B2 | 10/2008 | Rock et al. | |
| 7,718,839 | B2 | 5/2010 | Baumgartner et al. | |
| 7,829,752 | B2 | 11/2010 | Baumgartner et al. | |
| 7,833,408 | B2 | 11/2010 | Ramamurthy | |
| 9,738,572 | B2 | 8/2017 | Jani et al. | |
| 2011/0232160 | A1 | 9/2011 | Siskin et al. | |
| 2011/0245555 | A1 * | 10/2011 | Krupa | C07C 2/08 585/264 |
| 2012/0016164 | A1 | 1/2012 | Kohnz et al. | |
| 2012/0061294 | A1 | 3/2012 | Choi et al. | |
| 2012/0095269 | A1 | 4/2012 | Tanto et al. | |
| 2014/0109465 | A1 | 4/2014 | Coppola et al. | |
| 2016/0145499 | A1 | 5/2016 | Choi et al. | |
| 2016/0272901 | A1 * | 9/2016 | Choi | C10G 47/32 |
| 2017/0107433 | A1 | 4/2017 | Choi et al. | |
| 2017/0166821 | A1 | 6/2017 | Choi et al. | |

OTHER PUBLICATIONS

The International Search Report and Written Opinion for related PCT application PCT/US2019/017597 dated Jul. 19, 2019.

* cited by examiner

REMOVAL OF OLEFINS FROM HYDROTHERMALLY UPGRADED HEAVY OIL

TECHNICAL FIELD

Disclosed are methods for upgrading petroleum. Specifically, disclosed are methods and systems for removal of olefins from a supercritical water upgraded petroleum.

BACKGROUND

Crude oils contain sulfurs that must be removed in order to meet environmental regulations. Supercritical water processes can upgrade the crude oils, including removing an amount of sulfur. However, further treatment of the supercritical water upgraded oil to meet specifications and regulations is required. Further treatment is required to reduce the concentration of sulfur. A hydrotreater can be coupled to the supercritical water process to treat the supercritical water upgraded oil stream as shown in FIG. 1.

A hydrotreater, using a catalyst and hydrogen, can be used to remove heteroatoms, such as sulfur and nitrogen, from a petroleum stream, ranging from light naphtha to heavy residue. Over the catalyst, hydrogen is supplied to hydrocarbon molecules for hydrogenation and hydrogenolysis, such as saturation, hydrodesulfurization, hydrodenitrogenation, hydrodeoxygenation, and hydrodemetallization. The hydrodesulfurization and hydrodenitrogenation reactions produce hydrogen sulfide and ammonia, respectively.

However, petroleum, including supercritical water upgraded oil, contains poisons and inhibitors. One inhibitor is nitrogen compounds that can strongly adsorb on the active sites where hydrodesulfurization occurs and retard reaction progress. Aromatics can also inhibit the functionality of the catalyst, although to a lesser extent than the nitrogen compounds. Due to an abundance of aromatics in feedstocks, aromatics can be regarded as "everlasting" inhibitors for hydrotreating. In most petroleum feeds, the nitrogen concentration is less than 0.1 wt % nitrogen, while the aromatic concentration can be between 10 weight percent (wt %) and 90 wt %. Hydrogen sulfide and ammonia can also be inhibitors. Finally, olefins present in petroleum streams are inhibitors in hydrotreating reactions. Olefins can compete against sulfur compounds for active catalyst sites, such that olefins can be adsorbed on the same active sites and sulfur compounds. Additionally, hydrogenation of olefins occurring during hydrotreatment can have a high exothermicity, which can increase reactor temperature.

SUMMARY

Disclosed are methods for upgrading petroleum. Specifically, disclosed are methods and systems for removal of olefins from a supercritical water upgraded petroleum.

In a first aspect, a method for sulfur removal and upgrading. The method includes the steps of mixing a heated oil feed and a supercritical water feed in a feed mixer to produce a mixed stream, introducing the mixed stream to a supercritical water reactor, allowing conversion reactions to occur in the supercritical water reactor to produce a reactor effluent, introducing the reactor effluent to a cooling device, reducing the temperature of the reactor effluent in the cooling device to produce a cooled fluid, introducing the cooled fluid to a depressurizing device, reducing the pressure of the cooled fluid in the depressurizing device to produce a discharged fluid, introducing the discharged fluid to a gas-liquid separator, separating the discharged fluid in the gas-liquid separator to produce a gas phase product and a liquid phase product, feeding the liquid phase product to a pump, increasing the pressure of liquid phase product to produce pressurized liquid product, where the pressure of pressurized liquid product is greater than the critical pressure of water, introducing the pressurized liquid product to a hydration reactor, where the pressurized liquid product includes water, processing the hydration reactor to produce a hydrated oil stream, wherein the hydrated oil stream includes water and oxygenates, introducing the hydrated oil stream to an extraction unit, separating the hydrated oil stream to produce an extracted upgraded oil and an oxygenate concentrated stream, where the oxygenate concentrated stream includes the oxygenates and water, feeding the extracted upgraded oil to a hydrotreater, and processing the extracted upgraded oil in the hydrotreater to produce a desulfurized upgraded oil.

In certain aspects, the hydration reactor includes a hydration catalyst. In certain aspects, the hydration catalyst is selected from the group consisting of a solid acid catalyst, a heteropolyacid, a zeolite, a titanium dioxide, an alumina, and combinations of the same. In certain aspects, the hydration reactor is selected from a CSTR, a tubular reactor, a vessel-type reactor, and combinations of the same. In certain aspects, the hydration reactor is at a temperature between 300 deg C. and 374 deg C. In certain aspects, the hydrated oil stream includes a decreased amount of olefins relative to the pressurized liquid product. In certain aspects, the desulfurized upgraded oil includes a decreased amount of sulfur relative to the heated oil feed.

In a second aspect, a method for sulfur removal is provided. The method includes the steps of introducing a mixed stream to a supercritical water reactor, the mixed stream includes supercritical water and hydrocarbons, allowing conversion reactions to occur in the supercritical water reactor to produce a reactor effluent, introducing the reactor effluent to a cooler, reducing the temperature of the reactor effluent in the cooling device to produce a cooled effluent, introducing the cooled effluent to a hydration reactor, processing the cooled effluent in the hydration reactor to produce a hydrated effluent, introducing the hydrated effluent to a cooling device, reducing the temperature of the hydrated effluent in the cooling device to produce a cooled treated effluent, introducing the cooled treated effluent to a depressurizing device, reducing the pressure the cooled treated effluent in the depressurizing device to produce a depressurized effluent, introducing the depressurized effluent to a gas-liquid separator, separating the depressurized effluent in the gas-liquid separator to produce a vapor product and a liquid product, feeding the liquid product to an oil-water separator, separating the liquid product in the oil-water separator to produce an upgraded oil and an oxygenated water, wherein the oxygenated water includes oxygenates, introducing the upgraded oil to a hydrotreater unit, and processing the upgraded oil in the hydrotreater unit to produce a desulfurized upgraded oil.

In certain aspects, the method further includes the steps of introducing the oxygenated water to an oxygenates separator, and separating the oxygenated water in the oxygenates separator to produce a separated water and an oxygenates stream, where the oxygenates stream includes a concentration of oxygenates. In certain aspects, the method further includes the steps of mixing the oxygenates stream and a water feed in a feed mixer to produce an oxygenated water feed, where the oxygenated water feed includes oxygenates, introducing oxygenated water feed to a water pump, increasing the pressure of the oxygenated water feed to produce a pressurized water stream, introducing the pressurized water stream to a decomposition reactor, where the temperature in the decomposition reactor is between 550 deg C. and 600 deg C., facilitating the decomposition of oxygenates in the pressurized water stream to produce a heated water feed, wherein the decomposition of oxygenates converts the oxygenates to non-olefinic compounds, and mixing the heated water feed with a feed oil to produce the mixed stream. In certain aspects, the residence time in the decomposition reactor is at least 10 seconds. In certain aspects, the concentration of oxygenates in oxygenates stream is at least 10 wt %.

In a third aspect, a method of sulfur removal and upgrading a feed oil is provided. The method includes the steps of introducing the feed oil and a water feed to a supercritical water unit, operating the supercritical water unit to produce a gas phase product, a water product, and an upgraded feed oil. The method further includes the steps of introducing the upgraded feed oil to an olefin converter that operates at a temperature less than 250 deg C. and a pressure of less than 10 MPa such that olefins are in the vapor phase, processing the upgraded feed oil in the olefin converter to produce a reduced olefin stream, where the amount of olefins in the reduced olefin stream is reduced relative to the amount of olefins in the upgraded feed oil, introducing the reduced olefin stream to a hydrotreater unit that includes a hydrotreating catalyst, and processing the reduced olefin stream in the hydrotreater to produce a desulfurized upgraded oil.

In certain aspects, the step of operating the supercritical water unit to produce the gas phase product, the water product, and the upgraded feed oil includes the steps of mixing a heated oil feed and a supercritical water feed in a feed mixer to produce a mixed stream, introducing the mixed stream to a supercritical water reactor, allowing conversion reactions to occur in the supercritical water reactor to produce a reactor effluent, introducing the reactor effluent to a cooling device, reducing the temperature of the reactor effluent in the cooling device to produce a cooled fluid, introducing the cooled fluid to a depressurizing device, reducing the pressure of the cooled fluid in the depressurizing device to produce a discharged fluid, introducing the discharged fluid to a gas-liquid separator, separating the discharged fluid in the gas-liquid separator to produce a gas phase product and a liquid phase product, introducing the liquid phase product to an oil-water separator, and separating the liquid phase product in the oil-water separator to produce a water product and an upgraded feed oil. In certain aspects, the olefin converter can be selected from the group consisting of a catalytic hydrogenation unit and a catalytic alkylation unit. In certain aspects, wherein the hydrotreating catalyst includes a metal sulfide, the metal sulfide selected from the group consisting of cobalt-molybdenum sulfides, nickel-molybdenum sulfides, nickel tungsten sulfides, and combinations of the same. In certain aspects, the feed oil is selected from the group includes petroleum, coal liquid, and biomaterials.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

Figure 1:
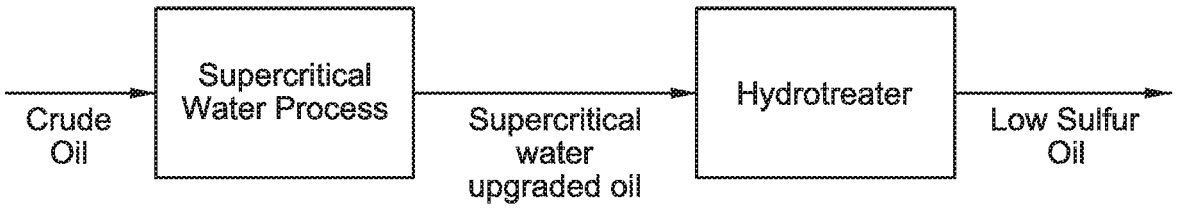
FIG. 1 (Prior Art)
FIG. 1 provides a process diagram of a prior art process.

In the accompanying Figures, similar components or features, or both, may have a similar reference label.

DETAILED DESCRIPTION

While the scope of the apparatus and method will be described with several embodiments, it is understood that one of ordinary skill in the relevant art will appreciate that many examples, variations and alterations to the apparatus and methods described here are within the scope and spirit of the embodiments.

Accordingly, the embodiments described are set forth without any loss of generality, and without imposing limitations, on the embodiments. Those of skill in the art understand that the scope includes all possible combinations and uses of particular features described in the specification.

Described here are processes and systems for sulfur removal. Advantageously, the sulfur removal processes can convert olefins from a supercritical water product to oxygenates utilizing the water present in the supercritical water process. Oxygenates in the supercritical water product can be extracted and mixed with the feed water before being introduced to the supercritical water reactor and converted to aromatics. Advantageously, the oxygenates can be converted to aromatics in the supercritical water reactor minimizing the loss of hydrocarbons. Advantageously, the sulfur removal process combines a supercritical water unit, a method for removing olefins, and a hydrotreater to produce an upgraded oil product with a reduced sulfur content. Advantageously, the reduced sulfur upgraded oil product can be used as a low sulfur marine fuel and as a feedstock for steam cracker where light olefins, such as ethylene, propylene, butenes, and combinations of the same, can be produced.

Hydrocarbon reactions in supercritical water upgrade heavy oil and crude oil containing sulfur compounds to produce products that have increased light fractions. Supercritical water has unique properties making it suitable for use as a petroleum reaction medium where the reaction objectives can include conversion reactions, desulfurization reactions denitrogenation reactions, and demetallization reactions. Supercritical water is water at a temperature at or greater than the critical temperature of water and at a pressure at or greater than the critical pressure of water. The critical temperature of water is 373.946° C. The critical pressure of water is 22.06 megapascals (MPa). Advantageously, at supercritical conditions water acts as both a hydrogen source and a solvent (diluent) in conversion reactions, desulfurization reactions and demetallization reactions and a catalyst is not needed. Hydrogen from the water molecules is transferred to the hydrocarbons through direct transfer or through indirect transfer, such as the water gas shift reaction.

Without being bound to a particular theory, it is understood that the basic reaction mechanism of supercritical water mediated petroleum processes is the same as a free radical reaction mechanism. Radical reactions include initiation, propagation, and termination steps. With hydrocarbons initiation is the most difficult step. Initiation requires the breaking of chemical bonds. Thermal energy creates radicals through chemical bond breakage. Supercritical water creates a "cage effect" by surrounding the radicals. The radicals surrounded by water molecules cannot react easily with each other, and thus, intermolecular reactions that contribute to coke formation are suppressed. The cage effect suppresses coke formation by limiting inter-radical reactions. Supercritical water, having low dielectric constant, dissolves hydrocarbons and surrounds radicals to prevent the inter-radical reaction, which is the termination reaction resulting in condensation (dimerization or polymerization). Because of the barrier set by the supercritical water cage, hydrocarbon radical transfer is more difficult in supercritical water as compared to compared to conventional thermal cracking processes, such as delayed coker, where radicals travel freely without such barriers.

Sulfur compounds released from sulfur-containing molecules can be converted to $H_2S$, mercaptans, and elemental sulfur. Without being bound to a particular theory, it is believed that hydrogen sulfide is not "stopped" by the supercritical water cage due its small size and chemical structure similar to water ($H_2O$). Hydrogen sulfide can travel freely through the supercritical water cage to propagate radicals and distribute hydrogen. Hydrogen sulfide can lose its hydrogen due to hydrogen abstraction reactions with hydrocarbon radicals. The resulting hydrogen-sulfur (HS) radical is capable of abstracting hydrogen from hydrocarbons which will result in formation of more radicals. Thus, $H_2S$ in radical reactions acts as a transfer agent to transfer radicals and abstract hydrogen.

As used throughout, "external supply of hydrogen" refers to the addition of hydrogen to the feed to the reactor or to the reactor itself. For example, a reactor in the absence of an external supply of hydrogen means that the feed to the reactor and the reactor are in the absence of added hydrogen, gas ($H_2$) or liquid, such that no hydrogen (in the form $H_2$) is a feed or a part of a feed to the reactor.

As used throughout, "external supply of catalyst" refers to the addition of catalyst to the feed to the reactor or the presence of a catalyst in the reactor, such as a fixed bed catalyst in the reactor. For example, a reactor in the absence of an external supply of catalyst means no catalyst has been added to the feed to the reactor and the reactor does not contain a catalyst bed in the reactor.

As used throughout, "external supply of oxygen gas" refers to the addition of molecular oxygen gas to the feed to the reactor or to the reactor itself. For example, a reactor in the absence of an external supply of oxygen gas means that the feed to the reactor and the reactor are in the absence of added oxygen, gas ($O_2$) or liquid, such that no oxygen (in the form $O_2$) is a feed or a part of a feed to the reactor.

As used throughout, "atmospheric residue" or "atmospheric residue fraction" refers to the fraction of oil-containing streams having an initial boiling point (IBP) of 650 deg F., such that all of the hydrocarbons have boiling points greater than 650 deg F. and includes the vacuum residue fraction. Atmospheric residue can refer to the composition of an entire stream, such as when the feedstock is from an atmospheric distillation unit, or can refer to a fraction of a stream, such as when a whole range crude is used.

As used throughout, "vacuum residue" or "vacuum residue fraction" refers to the fraction of oil-containing streams having an IBP of 1050 deg F. Vacuum residue can refer to the composition of an entire stream, such as when the feedstock is from a vacuum distillation unit or can refer to a fraction of stream, such as when a whole range crude is used.

As used throughout, "asphaltene" refers to the fraction of an oil-containing stream which is not soluble in a n-alkane, particularly, n-heptane.

As used throughout, "heavy fraction" refers to the fraction in the petroleum feed having a true boiling point (TBP) 10% that is equal to or greater than 650 deg F. (343 deg C.), and alternately equal to or greater than 1050 deg F. (566 deg C.). Examples of a heavy fraction can include the atmospheric residue fraction or vacuum residue fraction. The heavy fraction can include components from the petroleum feed that were not converted in the supercritical water reactor. The heavy fraction can also include hydrocarbons that were dimerized or oligomerized in the supercritical water reactor due to either lack of hydrogenation or resistance to thermal cracking.

As used throughout, "light fraction" refers to the fraction in the petroleum feed that is not considered the heavy fraction. For example, when the heavy fraction refers to the fraction having a TBP 10% that is equal to or greater than 650 deg F. the light fraction has a TBP 90% that is less than 650 deg F. For example, when the heavy fraction refers to the fraction having a TBP 10% equal to or greater than 1050 deg F. the light fraction has a TBP 90% that is less than 1050 deg F.

As used throughout, "light naphtha" refers to the fraction in the petroleum feed having a boiling point less 240 deg C.

As used throughout, "distillate" refers to the hydrocarbon fraction lighter than the distillation residue from an atmospheric distillation process or a vacuum distillation process.

As used throughout, "coke" refers to the toluene insoluble material present in petroleum.

As used throughout, "cracking" refers to the breaking of hydrocarbons into smaller ones containing fewer carbon atoms due to the breaking of carbon-carbon bonds.

As used throughout, "upgrade" means one or all of increasing API gravity, decreasing the amount of impurities, such as sulfur, nitrogen, and metals, decreasing the amount of asphaltene, and increasing the amount of distillate in a process outlet stream relative to the process feed stream. One of skill in the art understands that upgrade can have a relative meaning such that a stream can be upgraded in comparison to another stream, but can still contain undesirable components such as impurities.

As used throughout, "conversion reactions" refers to reactions that can upgrade a hydrocarbon stream including cracking, isomerization, alkylation, dimerization, aromatization, cyclization, desulfurization, denitrogenation, deasphalting, and demetallization.

As used throughout, "poison" means compounds that reduce catalyst activity permanently.

As used throughout, "inhibitor" refers to compounds that reduce catalyst activity temporally.

As used throughout "oxygenate" refers to hydrocarbons containing oxygen such as alcohols and aldehydes.

The following embodiments, provided with reference to the figures, describe the upgrading process.

Figure 2:
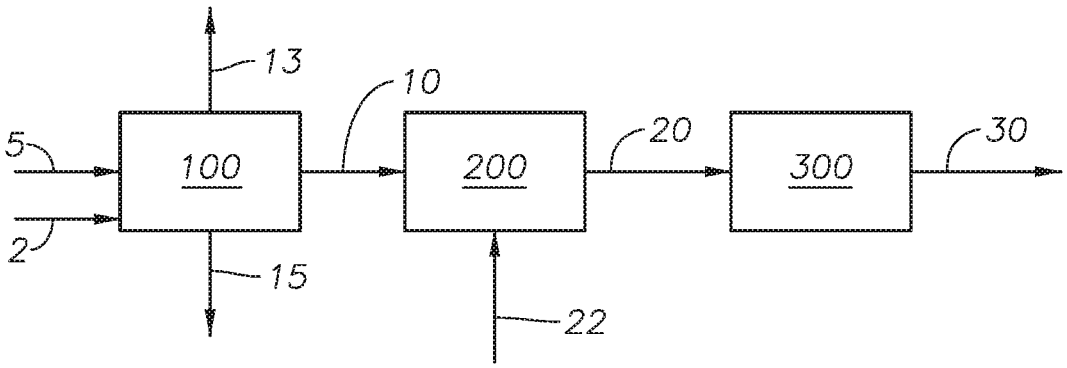
FIG. 2 provides a process diagram of an embodiment of the process.

Referring to FIG. 2, a general process flow diagram of a sulfur removal upgrading process is described.

Feed oil 5 and water feed 2 can be introduced to supercritical water unit 100. Feed oil 5 can be any crude oil source derived from petroleum, coal liquid, biomaterials, and gas-to-liquid (GTL) products. Examples of feed oil 5 can include whole range crude oil, reduced crude oil, atmospheric distillates, atmospheric residue, vacuum distillates, vacuum residue, refinery streams, produced oil, hydrocarbon streams from upstream operations, decanted oil, streams containing C10+ oil from an ethylene plant, liquefied coal, and biomass derived hydrocarbons, such as bio fuel oil. In at least one embodiment, feed oil 5 can include a whole range crude oil and a distillation residue from crude oil. The whole range crude oil can be any crude oil having an API gravity between 22 and 50 and alternately between 24 and 40 and a total sulfur content between 0.05 wt % and 4 wt % sulfur. An example of a whole range crude oil having an API gravity of 24 and a 3.6 wt % sulfur content is Manifa Crude Oil. An example of a whole range crude oil having an API gravity of 40 and a total sulfur content of 1.0 wt % is Arab Extra Light. The distillation residue from crude oil can be any residue stream from crude oil having an API gravity in the range between −1 and 22 and alternately between 2.5 and 20.5. The total sulfur content of the distillation residue from crude oil can be between 1.5 wt % and 7.5 wt % and alternately between 2.1 wt % and 6.5 wt %. An example of a distillation residue from a crude oil is a vacuum residue of a Manifa Crude Oil having an API gravity of 2.5 and 6.5 wt %. An example of a distillation residue from a crude oil is an atmospheric residue of an Arab Extra Light having an API gravity of 20.5 and 2.1 wt %. "Reduced crude oil" can also be known as "topped crude oil" and refers to a crude oil having no light fraction, and would include an atmospheric residue stream or a vacuum residue stream. "Refinery streams" can include "cracked oil," such as light cycle oil, heavy cycle oil, and streams from a fluid catalytic cracking unit (FCC), such as slurry oil or decant oil, a heavy stream from hydrocracker with a boiling point greater than 650 deg F., a deasphalted oil (DAO) stream from a solvent extraction process, and a mixture of atmospheric residue and hydrocracker bottom fractions. In at least one embodiment, feed oil 5 is in the absence of olefins.

Water feed 2 can be any demineralized water having a conductivity less than 1.0 microSiemens per centimeter (μS/cm), alternately less 0.5 μS/cm, and alternately less than 0.1 μS/cm. In at least one embodiment, water feed 2 is demineralized water having a conductivity less than 0.1 μS/cm.

Water feed 2 and feed oil 5 can be processed in supercritical water unit 100 to produce upgraded feed oil 10. Supercritical water unit 100 can be described with reference to FIG. 3 and reference to FIG. 2.

Feed oil 5 can be passed to oil feed pump 106. Oil feed pump 106 can be any type of pump capable of increasing the pressure of feed oil 5. In at least one embodiment, oil feed pump 106 is a diaphragm metering pump. The pressure of feed oil 5 can be increased in oil feed pump 106 to produce pressurized oil feed 116. The pressure of pressurized oil feed 116 can be greater than the critical pressure of water, alternately between 23 MPa and 35 MPa, and alternately between 24 MPa and 30 MPa. Pressurized oil feed 116 can be introduced to oil feed heater 108.

Oil feed heater 108 can be any type of heat exchanger capable increasing the temperature of pressurized oil feed 116. Examples of heat exchangers capable of being used as oil feed heater 108 can include an electric heater, a fired heater, and a cross exchanger. In at least one embodiment, oil feed heater 108 can be cross exchanged with reactor effluent 125. The temperature of pressurized oil feed 116 can be increased in oil feed heater 108 to produce heated oil feed 118. The temperature of heated oil feed 118 can be less than the critical temperature of water and alternately less than 250 deg C. Maintaining the temperature of heated oil feed 118 at less than 300 deg C. reduces the formation of coke in heated oil feed 118 and in supercritical water reactor 120.

Water feed 2 can be introduced to water pump 102. Water pump 102 can be any type of pump capable of increasing the pressure of water feed 2. In at least one embodiment, water pump 102 is a diaphragm metering pump. The pressure of water feed 2 can be increased in water pump 102 to a pressure greater than the critical pressure of water, alternately to a pressure between 23 MPa and 35 MPa, and alternately between 24 MPa and 30 MPa, to produce pressurized water stream 112. Pressurized water stream 112 can be passed to water heater 104.

Water heater 104 can be any type of heat exchanger capable of increasing the temperature of pressurized water stream 112. Examples of heat exchangers that can be used as water heater 104 can include an electric heater and a fired heater. The temperature of pressurized water stream 112 can be increased in water heater 104 to produce supercritical water feed 114. The temperature of supercritical water feed 114 can be equal to or greater than the critical temperature of water, alternately greater than 380 deg C., alternately between 374 deg C. and 600 deg C., and alternately between 380 deg C. and 550 deg C.

Heated oil feed 118 and supercritical water feed 114 can be passed to feed mixer 110. Feed mixer 110 can be any type of mixing device capable of mixing a petroleum stream and a supercritical water stream. Examples of mixing devices suitable for use as feed mixer 110 can include a simple tee, ultrasonic device, static mixer, an inline mixer, and impeller-embedded mixer. The ratio of the volumetric flow rate of heated oil feed 118 to supercritical water feed 114 can be between 1:10 and 10:1 at standard temperature and pressure (SATP), alternately between 1:5 and 5:1 at SATP, and alternately between 1:1 and 1:3. In at least one embodiment, the ratio of the volumetric flow rate of heated oil feed 118 to supercritical water feed 114 is such that there is a greater amount of water than oil by volume at SATP. Heated oil feed 118 and supercritical water feed 114 can be mixed to produce mixed stream 115. The pressure of mixed stream 115 can be greater than the critical pressure of water. The temperature of mixed stream 115 can depend on the temperatures of supercritical water feed 114 and heated oil feed 118. In at least one embodiment, controlling the temperature of supercritical water feed 114 controls the temperature of mixed stream 115. The temperature of mixed stream 115 can be maintained at equal to or less than the desired reaction temperature in supercritical water reactor 120. In at least one embodiment, mixed stream 115 is less than the temperature in supercritical water reactor 120 to avoid shocking the hydrocarbons in heated oil feed 118 when heated oil feed 118 is mixed with supercritical water feed 114. Mixed stream 115 can be introduced to supercritical water reactor 120.

Supercritical water reactor 120 can include one or more reactors in series. Supercritical water reactor 120 can be any type of reactor capable of allowing conversion reactions. Examples of reactors suitable for use in supercritical water reactor 120 can include tubular-type vertical reactor, tubular type horizontal reactor, vessel-type reactor, CSTR-type, and combinations of the same. In at least one embodiment, supercritical water reactor 120 includes a tubular-type vertical reactor, which advantageously prevents precipitation of reactants and products. Supercritical water reactor 120 can include an upflow reactor, a downflow reactor, and a combination of an upflow reactor and downflow reactor. In at least one embodiment, supercritical water reactor 120 is in the absence of an external supply of catalyst. In at least one embodiment, supercritical water reactor 120 is in the absence of an external supply of hydrogen.

The temperature in supercritical water reactor 120 can be maintained in the range between the critical temperature of water and 450 deg C., alternately in the range between 380 deg C. and 450 deg C., alternately in the range between 400 deg C. and 450 deg C., and alternately in the range between 390 deg C. and 450 deg C. The temperature in supercritical water reactor 120 is maintained in the range of between the critical temperature of water and 450 deg C. to suppress the formation of coke in supercritical water reactor 120, which can occur at temperatures greater than 450 deg C. The pressure in supercritical water reactor 120 can be maintained at a pressure greater than the critical pressure of water, alternately in the range between 23 MPa and 35 MPa, and alternately between 24 MPa and 30 MPa. The residence time of the reactants in supercritical water reactor 120 can between greater than 5 seconds, and alternately greater than 1 minute. The residence time is calculated by assuming that the density of the reactants in supercritical water reactor 120 is the same as the density of water at the operating conditions of supercritical water reactor 120.

The reactants in supercritical water reactor 120 can undergo conversion reactions to produce reactor effluent 125. Reactor effluent 125 can be introduced to cooling device 130.

Cooling device 130 can be any type of heat exchange device capable of reducing the temperature of reactor effluent 125. Examples of cooling device 130 can include double pipe type exchanger and shell-and-tube type exchanger. In at least one embodiment, cooling device 130 can be a cross exchanger with pressurized oil feed 116. The temperature of reactor effluent 125 can be reduced in cooling device 130 to produce cooled fluid 135. The temperature of cooled fluid 135 can be between 10 deg C. and 200 deg C. and alternately between 30 deg C. and 150 deg C. Cooled fluid 135 can be introduced to depressurizing device 140.

Depressurizing device 140 can be any type of device capable of reducing the pressure of a fluid stream. Examples of depressurizing device 140 can include a pressure let-down valve, a pressure control valve, and a back pressure regulator. The pressure of cooled fluid 135 can be reduced to produce discharged fluid 145. The pressure of discharged fluid 145 can be less than the critical pressure of water, alternately less than 2 MPa, and alternately 0.2 MPa.

Discharged fluid 145 can be introduced to gas-liquid separator 150. Gas-liquid separator 150 can be any type of separation device capable of separating a fluid stream into gas phase and liquid phase. The temperature of gas-liquid separator 150 can be maintained at a temperature between 10 deg C. and 150 deg C. The pressure in gas-liquid separator 150 can be between ambient pressure and 0.2 MPa. Discharged fluid 145 can be separated to produce gas phase product 13 and liquid phase product 155. Liquid phase product 155 can be introduced to oil-water separator 160.

Oil-water separator 160 can be any type of separation device capable of separating a fluid stream into a hydrocarbon containing stream and a water stream. Oil-water separator 160 can include a settling chamber, an API separator, and a combination of a settling chamber and an API separator. Liquid phase product 155 can be separated in oil-water separator 160 to produce upgraded feed oil 10 and water product 15. The conditions in oil-water separator 160 can be designed to minimize the amount of water in upgraded feed oil 10. Oil-water separator 16 can contain less than 0.3 wt % water. Upgraded feed oil 10 contains upgraded hydrocarbons relative to feed oil 5.

Returning to FIG. 2, upgraded feed oil 10 can be introduced to olefin converter 200 along with hydrogen gas 22. Hydrogen gas 22 can include molecular hydrogen.

Olefin converter 200 can be any type of unit capable of converting olefins in the presence of an external supply of hydrogen. Examples of olefin converter 200 include a catalytic hydrogenation unit and a catalytic alkylation unit. Olefin converter 200 can operate in the absence of water. Olefin converter 200 can include an olefin catalyst. The olefin catalyst can be selected from a hydrogenation catalyst and an alkylation catalyst. The hydrogenation catalyst can convert olefins by saturating the olefins to form alkanes. The hydrogenation catalyst can include precious metals, such as palladium supported on activated carbon. However, precious metal catalysts, such as platinum and palladium, can be permanently poisoned by the presence of sulfur. The alkylation catalyst can be any type of catalyst capable of consuming olefin to form alkylated aromatics. Examples of the alkylation catalyst can include solid acid catalyst and zeolite-based catalyst. Upgraded feed oil 10 can be processed in olefin converter 200 to produce reduced olefin stream 20. Minimizing the amount of water in upgraded feed oil 10 improves performance in olefin converter 200 when the olefin catalyst is a hydrogenation catalyst, because water can poison a hydrogenation catalyst. In embodiments where olefin converter 200 is a catalytic hydrogenation unit containing a hydrogenation catalyst, olefin converter 200 can be operated a temperature less than 250 deg C. and alternately less than 200 deg C. and a pressure of less than 10 MPa, such that the naphtha-range fraction with a boiling point less than 220 deg C. is in the vapor phase. Olefin saturation occurs in the vapor phase while many of the sulfur compounds stay in the liquid phase. Olefin saturation is an exothermic reaction, which can increase the temperature in olefin converter 200. Olefin converter 200 is in the absence of water. Reduced olefin stream 20 can be introduced to hydrotreater unit 300.

Advantageously, olefin converter 200 removes olefins from upgraded feed oil 10 and reduces the amount of olefins in reduced olefin stream 20 relative to upgraded feed oil 10. In at least one embodiment, the amount of olefins in upgraded feed oil 10 can be reduced by at least 80 wt % in reduced olefin stream 20. Having a reduced amount of olefins means that reduced olefin stream 20 can exhibit less inhibition of the hydrotreating catalyst in hydrotreater unit 300 as compared to upgraded feed oil 10 and feed oil 5. Removing olefins upstream of hydrotreater unit 300 can reduce the opportunity for olefins to recombine with hydrogen sulfide to produce thiols and thiophenes.

Reduced olefin stream 20 can be processed in hydrotreater unit 300 to produce desulfurized upgraded oil 30. Hydrotreater unit 300 can be any type of processing unit capable of removing sulfur from a hydrocarbon stream. In at least one embodiment, upgrading reactions can occur in hydrotreater unit 300 in addition to desulfurization reactions. Hydrotreater unit 300 can include hydrotreating catalyst.

The hydrotreating catalyst can be selected based on the feedstock type, such as light or heavy, and the desired specifications of the product. For example, a hydrotreating catalyst for a heavy residue has an increased pore size and reduced surface area, due to the increased pore size, than a hydrotreating catalyst for a light distillate, such as naphtha, kerosene and gas oil. The increased pore size accommodates the larger molecules in the heavy residue. The hydrotreating catalyst can include metal sulfides and a support. Examples of metal sulfides can include cobalt-molybdenum sulfides (CoMoS), nickel-molybdenum sulfides (NiMoS), nickel-tungsten sulfides (NiWS), and combinations of the same. Examples of supports can include alumina based supports. The alumina based supports can include alumina, silica, and zeolites. The hydrotreating catalyst can include promoters, such as boron and phosphorous. In at least one embodiment, a hydrodemetallization (HDM) catalyst can be added as a first layer in hydrotreater unit 300 or can be employed in a separate reactor as part of hydrotreater unit 300. The temperature in hydrotreater unit 300 can be in the range between 250 deg C. and 450 deg C. The pressure in hydrotreater unit 300 can be in the range between 0.5 MPa and 25 MPa. The liquid hourly space velocity (LHSV) can be in the range between 0.1 per hour ($hr^{-1}$) and 5 $hr^{-1}$.

Desulfurized upgraded oil 30 can be further treated. Desulfurized upgraded oil 30 can be treated to separate gases, such as hydrogen, hydrogen sulfide, and gaseous hydrocarbons from the liquid hydrocarbons. Additional treatment steps can include separation, cooling, pressure reduction and combinations of the same. The liquid hydrocarbons in desulfurized upgraded oil 30 have reduced amounts of sulfur, reduced amounts of nitrogen, increased API, and greater amounts of distillate relative to feed oil 5.

Figure 3:
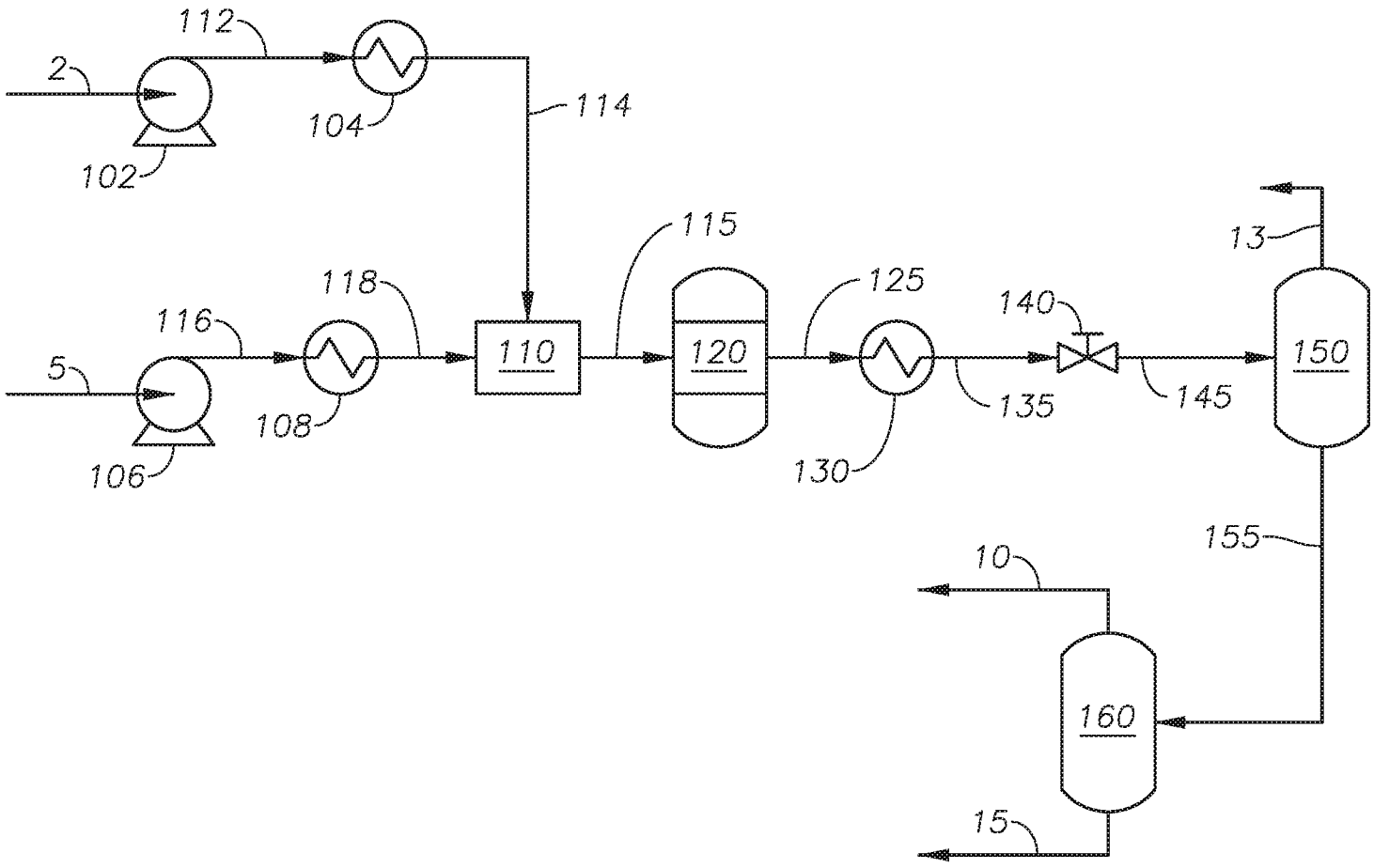
FIG. 3 provides a process diagram of an embodiment of the process.
Figure 4:
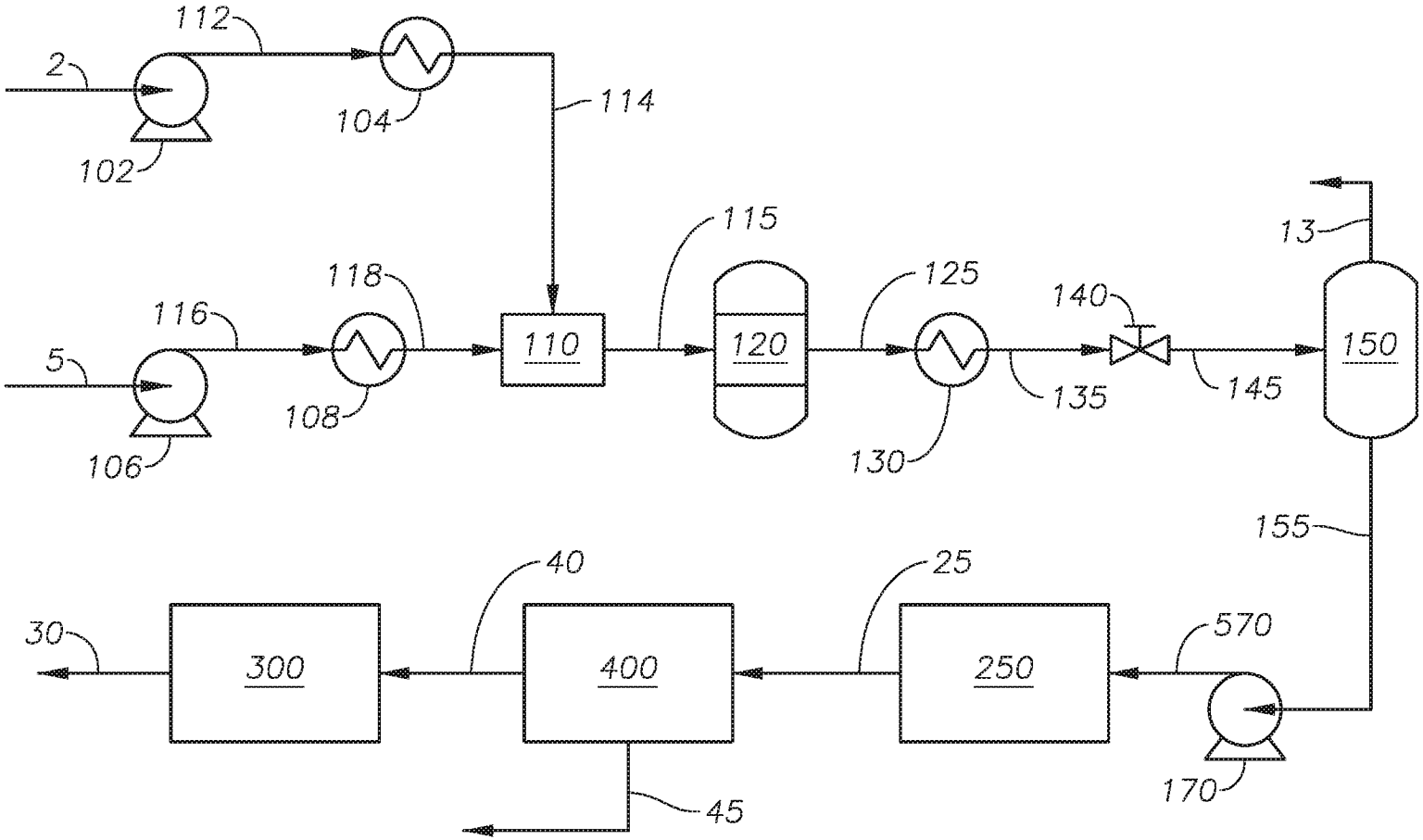
FIG. 4 provides a process diagram of an embodiment of the process.

An embodiment of the sulfur removal upgrading process is described with reference to FIG. 4 and FIGS. 2 and 3. Liquid phase product 155 can be introduced to pump 170. Pump 170 can increase the pressure of liquid phase product 155 to produce pressurized liquid product 570. The pressure of pressurized liquid product 570 can be greater than the critical pressure of water and alternately between 23 MPa and 25 Mpa. Pressurized liquid product 570 can be introduced to hydration reactor 250.

Hydration reactor 250 can be any process unit capable of hydrating olefins with water. Examples of hydration reactor 250 can include catalytic hydration unit and non-catalytic near critical water (NCW) hydration unit. In at least one embodiment, hydration reactor 250 is a NCW hydration unit. The reactor in hydration reactor 250 can be any reactor capable of allowing a hydration reaction to occur. Examples of the reactor in hydration reactor 250 can include a CSTR, a tubular reactor, a vessel-type reactor, and combinations of the same. The temperature in hydration reactor 250 can be between 300 deg C. and 374 deg C. and alternately 350 deg C. and 370 deg C. The pressure in hydration reactor 250 can be greater than the critical pressure of water and alternately between 23 MPa and 25 MPa. The residence time in hydration reactor 250 can be between 1 minute and 120 minutes and alternately between 30 minutes and 60 minutes. Advantageously, near-critical water has a greater ion dissociation constant (Kw) than liquid water. The Kw of near-critical water is 11, whereas the Kw for water at room temperature is about 14 and the Kw for supercritical water is about 20. The greater Kw of near-critical water results in abundant hydrogen ions (H+) and hydroxide ions (OH—) for use in the hydration reactions.

Hydration reactor 250 can include a hydration catalyst. The hydration catalyst can be any type of catalyst stable at the operating conditions in hydration reactor 250 and capable of hydrating olefins to form oxygenates. The hydration catalyst can include a solid acid catalyst, a heteropolyacid (HPA), a zeolite, titanium dioxide, alumina, and combinations of the same. The hydration catalyst does not include a homogeneous catalyst, such as nitric acid and sulfuric acid, because homogeneous catalysts require complicated handling and separation processes.

Hydration reactor 250 can include hydrating reactions in the presence of oxygen. The water in pressurized liquid product 570 can serve as the oxygen source. In at least one embodiment, hydration reactor 250 is in the absence of an external supply of oxygen gas. In at least one embodiment, hydration reactor 250 is in the absence of an external water supply.

Advantageously, positioning the hydration reactor 250 before separation of liquid phase product 155 into an oil stream and a water stream provides the water necessary for hydration reaction 250 and additional water is not provided to hydration reactor 250.

Hydration reactor 250 can allow hydration reactions to occur to produce hydrated oil stream 25. Hydrated oil stream 25 contains upgraded oil, water, oxygenates, and combinations of the same. Hydrated oil stream 25 can be introduced to extraction unit 400.

Extraction unit 400 can be any type of unit capable of separating the oxygenates in hydrated oil stream 25 from the upgraded oil to produce extracted upgraded oil 40 and oxygenate concentrated stream 45. Oxygenate concentrated stream 45 contains an amount of the water and an amount of the oxygenates present in hydrated oil stream 25. Oxygenate concentrated stream 45 contains greater than 99.7 wt % water. Examples of extraction unit 400 can include a vessel containing a settling chamber, an API separator, and combinations of the same. Extraction unit 400 can use the water present in hydrated oil stream 25 as an extracting solvent.

Extracted upgraded oil 40 can be introduced to hydrotreater unit 300 to produce desulfurized upgraded oil 30 as described with reference to FIG. 2.

An embodiment of the sulfur removal upgrading process can be described with reference to FIG. 5 and FIGS. 2-4. Reactor effluent 125 can be introduced to cooler 630. Cooler 630 can be any heat exchanger capable of reducing the temperature of reactor effluent 125 to produce cooled effluent 635. Examples of cooler 630 can include a double pipe type exchanger and shell-and-tube type exchanger. The temperature of reactor effluent 125 can be reduced in cooler 630. The temperature of cooled effluent 635 can be between 300 deg C. and 374 deg C. and alternately between 350 deg C. and 370 deg C. Cooled effluent 630 can be introduced to hydration reactor 250.

Cooled effluent 635 can be hydrated in hydration reactor 250 to produce hydrated effluent 640. Hydrated effluent 640 can be introduced to cooling device 135.

Cooling device 135 can reduce the temperature of hydrated effluent 640 to produce cooled treated effluent 645. Cooled treated effluent 645 can be at a temperature between 10 deg C. and 200 deg C. and alternately between 30 deg C. and 150 deg C. Cooled treated effluent 645 can be introduced to depressurizing device 140.

The pressure of cooled treated effluent 645 can be reduced to produce depressurized effluent 650. Depressurized effluent 650 can be at a pressure less than the critical pressure of water, alternately less than 2 MPa, and alternately 0.2 MPa. Depressurized effluent 650 can be introduced to gas-liquid separator 150.

Gas-liquid separator 150 can separate depressurized effluent 650 into vapor product 613 and liquid product 655. Vapor product 613 can contain reduced amounts of light olefins, such as ethylene and propylene, compared to a gas product downstream of conventional supercritical water process because olefins are hydrated to alcohols. Vapor product 613 can contain an amount of light alcohols, such as ethanol. Liquid product 655 can be introduced to oil-water separator 160.

Oil-water separator 160 can separate liquid product 655 into upgraded oil 610 and oxygenated water 615. Oxygenated water 615 can contain oxygenates, water, and combinations of the same. In at least one embodiment, oxygenated water 615 contains alcohols, aldehydes, oxygenates, and combinations of the same. The amount of oxygen in oxygenated water 615 can be in the range between 0.1 wt % and 5 wt %. Upgraded oil 610 can be introduced to hydrotreater unit 300.

Figure 5:
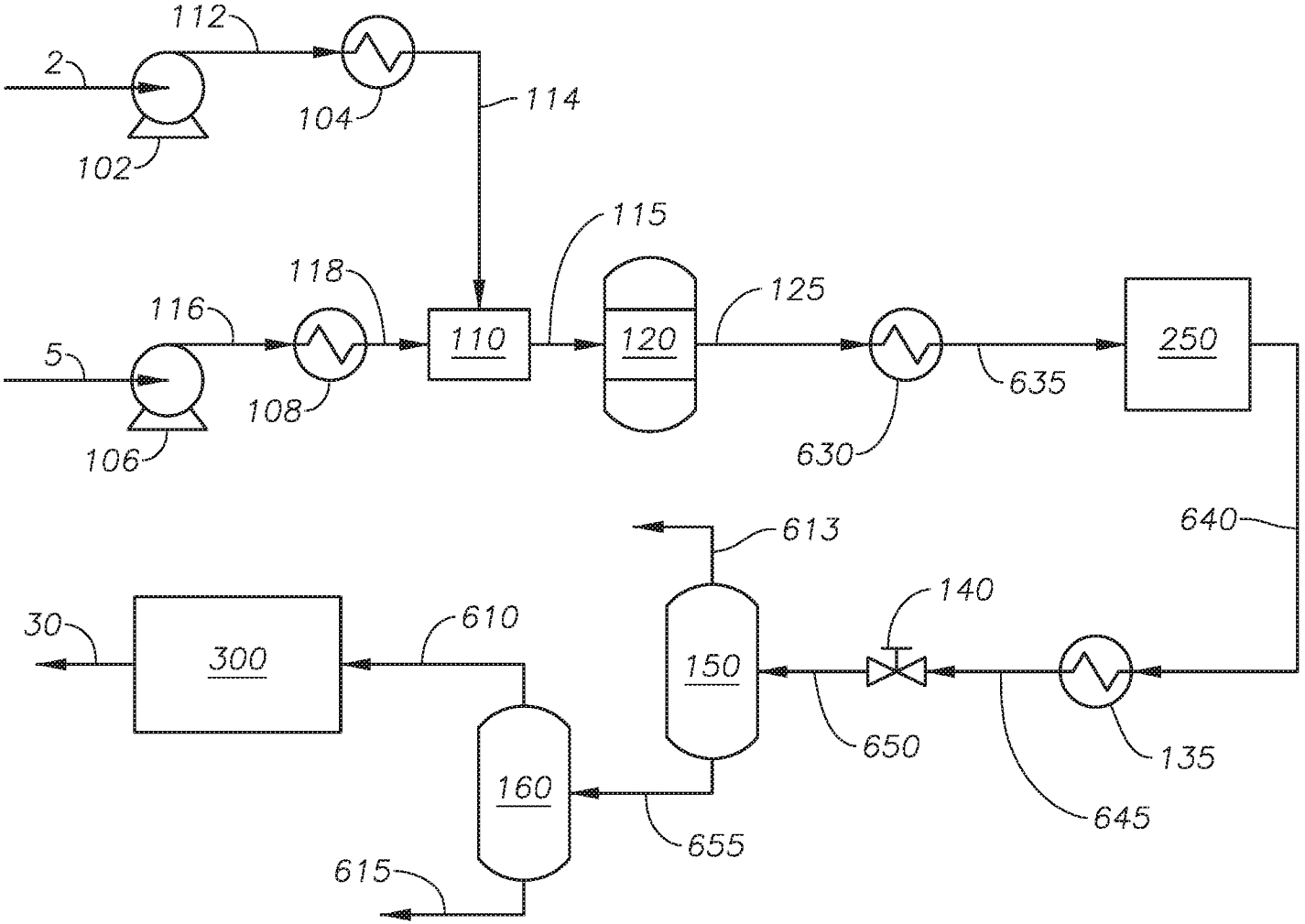
FIG. 5 provides a process diagram of an embodiment of the process.

Advantageously, the sulfur removal upgrading process described with reference to FIG. 5 shows that the heat and pressure in the supercritical water reactor can be used in the hydration reactor resulting in a process with increased efficiency.

An embodiment of the sulfur removal upgrading process can be described with reference to FIG. 6 and FIGS. 2-5. Oxygenated water 615 is introduced to oxygenates separator 700. Oxygenates separator 700 can be any type of separator capable of separating a fluid into two fluid streams. In at least one embodiment, oxygenates separator 700 is a distillation unit. Oxygenates separator 700 can separate oxygenated water 615 into separated water 715 and oxygenates stream 705.

Oxygenates stream 705 can contain water, an amount of the oxygenates present in oxygenated water 615, and combinations of the same. The oxygenates concentration present in oxygenates stream 705 is at least 10 wt % and alternately between 10 wt % and 40 wt %. Oxygenates separator 700 can be an extractor. The oxygenates concentration in oxygenates stream 705 can be at least 10 wt % to reject non-hydrocarbon impurities such as minerals, alkali chloride, and solid particles, into the water of separated water 715. Separated water 715 can contain non-hydrocarbon impurities, water, and combinations of the same.

Oxygenates stream 705 can be mixed with water feed 2 in feed mixer 750 to produced oxygenated water feed 702. Feed mixer 750 can be any type of mixing unit capable of mixing two fluid streams together. Oxygenated water feed 702 can be introduced to water pump 102. The pressure of oxygenated water feed 702 can be increased in water pump 102 to produce pressurized oxygenated stream 712. The pressure of pressurized oxygenated stream 712 can be greater than the critical pressure of water, alternately to a pressure between 23 MPa and 35 MPa, and alternately between 24 MPa and 30 MPa. Pressurized oxygenated stream 712 can be introduced to decomposition reactor 704.

Decomposition reactor 704 can be any type of reactor capable of increasing the temperature of pressurized oxygenated stream 712 and facilitating the decomposition of oxygenates present in pressurized oxygenated stream 712 to produce hot oxygenated water 714. Examples of decomposition reactor 704 can include coiled tube reactor and straight tubular reactor. Decomposition reactor 704 can operate at a temperature between 550 deg C. and 600 deg C. At the temperatures in decomposition reactor 704, oxygenates can be dehydrated to olefins, which are then converted to non-olefinic compounds. The pressure in decomposition reactor 704 can be controlled by the outlet pressure of water pump 102 and depressurizing device 140. Non-olefinic compounds can include aromatics, paraffins, and combinations of the same. At the temperatures in supercritical water reactor 120 aromatic formation from oxygenates does not occur. Water heater 104 is operated at 550 deg C. and 600 deg C. to decompose the oxygenates and increase aromatization. The residence time in decomposition reactor 704 can have a residence time of at least 10 seconds.

EXAMPLES

Figure 6:
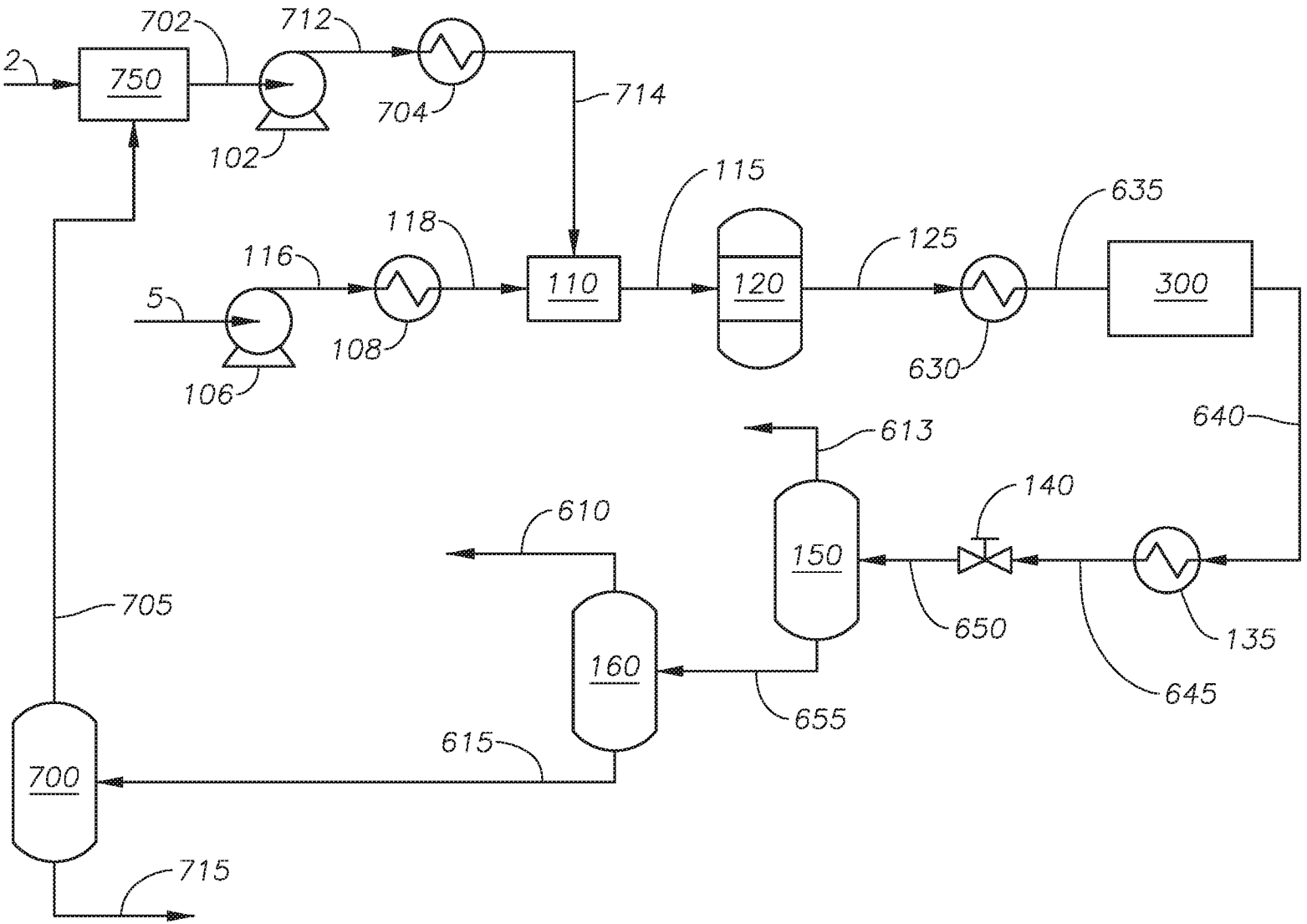
FIG. 6 provides a process diagram of an embodiment of the process.

Examples. The Example was conducted by a lab scale unit with a system as shown in FIG. 6 with reference to FIG. 3. Feed oil 5 was a whole range Arabian Heavy crude oil. Water feed 2 was a demineralized water having a conductivity of 0.55 μS/cm.

Feed oil 5 was pumped at a rate of 0.3 liters per hour (L/hour) in oil feed pump 106, a diaphragm pump. The temperature of pressurized oil feed 116 was increased in oil feed heater 108 to produce heated oil feed 118 at a temperature of 60 deg C. Oil feed heater 108 was an electric heater.

Water feed 2 was pumped at a rate of 1.2 L/hour in water pump 102, a diaphragm pump. The temperature of pressurized water stream 112 was increased in water heater 104 to produce supercritical water feed 114 at a temperature of 590 deg C. Water heater 104 was an electric heater.

The pressure of the sulfur removal process was regulated at 3,901 pounds per square inch (psig) (26.9 mega pascals (MPa)) by depressurizing device 140, a back pressure regulator.

The ratio of the volumetric flow rate of oil to the volumetric flow rate of water was 0.25 to 1 at SATP. The streams were mixed in feed mixer 110 and mixed stream 115 was introduced to supercritical water reactor 120.

Supercritical water reactor 120 was three tubular reactors arranged in series, each having an internal volume of 160 milliliter (ml). The flow direction in each reactor was downflow. The temperature in supercritical water reactor 120 was 420 deg C., measured by thermocouples at the end of each reactor, such that the internal fluid temperature was measured by thermocouple located at the end of each reactor. And each reactor was maintained at the same temperature. Residence time of mixed stream 115 in supercritical water reactor 120 was 3 minutes (0.0497 hours). The residence time was calculated by assuming the density of water at 420 deg C. and 3,901 psig was 0.15547 grams per milliliter (g/ml) and the total flow rate of water at 420 deg C. and 3,901 psig was 9.65 L/hour, and where the feed oil was assumed to have the same density of water at the reaction conditions.

The temperature of reactor effluent 125 was reduced in cooling device 130 to a temperature of 360 deg C. Cooled fluid 135 was introduced to hydration reactor 250.

Hydration reactor 250 was a CSTR with a catalyst basket attached to the agitator and an internal volume of 1,000 ml. The reaction temperature was 360 deg C. The hydration catalyst in the catalyst basket was a pellet-type ZSM-5 having a 3 to 5 millimeter (mm) size. The catalyst basket had a volume of 250 ml. The agitator speed was 600 revolutions per minute (rpm). The residence time was 24 minutes (assuming the density was the density of water at 360 deg C. and 3,901 psig, 0.600 g/ml, and the total flow rate was 2.5 L/hour). The temperature of hydrated oil stream 25 was reduced in cooling device 130 to a temperature of 63 deg C. The pressure of cooled treated effluent 645 was reduced in depressurizing device 140 to ambient pressure. Depressurized effluent 650 was separated in gas-liquid separator 150 to produce vapor product 613 and liquid product 655. Gas-liquid separator 150 was a 500 ml cylinder. Liquid product 655 was separated into upgraded oil 610 and oxygenated water 615. The organic compounds in the oxygenated water were extracted using n-hexane and analyzed.

In a comparative test run, reactor effluent 125 was cooled to 65 deg C., depressurized to ambient pressure and then separated into gas, oil, and water streams. The oil streams were analyzed.

The results of each run are in Table 1.

TABLE 1

Composition of Streams from the Example.

| | Feed Oil | Comparative Run | Sulfur Removal Process |
|---|---|---|---|
| API Gravity | 26.7 | 32.2 | 31.7 |
| Sulfur Content (wt %) | 2.9 | 2.4 | 2.4 |
| Olefin Content (vol %) | 0 | 1.36 | 0.27 |
| Oxygenate Content (wt %) | 0 | 0 | 1.23 |

The oxygenate content was measured in oxygenated water 615. The oxygenates in the oxygenated water were primarily mono alcohol, ranging from C5 to C15. In the comparative run, without the hydration step, 1.36 wt % of olefins would enter a hydrotreating unit. In contrast, in the sulfur removal process with a hydration step, following separation of oxygenated water 615, the amount of olefins in upgraded oil 610 is less than 0.27 wt %. Advantageously, the reduced amounts of olefins in upgraded oil 610 can be beneficial in further treatment processes.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

There various elements described can be used in combination with all other elements described here unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed here as from about one particular value to about another particular value and are inclusive unless otherwise indicated. When such a range is expressed, it is to be understood that another embodiment is from the one particular value to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made here.

As used here and in the appended claims, the words "comprise," "has," and "include" and all grammatical variations thereof are each intended to have an open, non-limiting meaning that does not exclude additional elements or steps.

That which is claimed is:

1. A method for sulfur removal and upgrading, the method comprising the steps of:

mixing a heated oil feed and a supercritical water feed in a feed mixer to produce a mixed stream, wherein a ratio of the volumetric flow rate of the heated oil feed to the supercritical water feed is such that there is a greater amount of water than oil by volume as measured at standard temperature and pressure (SATP);

introducing the mixed stream to a supercritical water reactor;

allowing conversion reactions to occur in the supercritical water reactor to produce a reactor effluent;

introducing the reactor effluent to a cooling device;

reducing the temperature of the reactor effluent in the cooling device to produce a cooled fluid;

introducing the cooled fluid to a depressurizing device;

reducing the pressure of the cooled fluid in the depressurizing device to produce a discharged fluid;

introducing the discharged fluid to a gas-liquid separator;

separating the discharged fluid in the gas-liquid separator to produce a gas phase product and a liquid phase product;

feeding the liquid phase product to a pump;

increasing the pressure of liquid phase product to produce pressurized liquid product, wherein the pressure of pressurized liquid product is greater than the critical pressure of water;

introducing the pressurized liquid product to a hydration reactor, wherein the pressurized liquid product comprises water;

processing the hydration reactor to produce a hydrated oil stream, wherein the hydrated oil stream comprises water and oxygenates, wherein the hydration reactor is at a temperature between 300 deg C. and 370 deg C. and a pressure of greater than the critical pressure of water such that water is near-critical in the liquid phase;

introducing the hydrated oil stream to an extraction unit;

separating the hydrated oil stream to produce an extracted upgraded oil and an oxygenate concentrated stream, wherein the oxygenate concentrated stream comprises the oxygenates and water;

feeding the extracted upgraded oil to a hydrotreater; and processing the extracted upgraded oil in the hydrotreater to produce a desulfurized upgraded oil.

2. The method of claim 1, wherein the hydration reactor comprises a hydration catalyst.

3. The method of claim 2, wherein the hydration catalyst is selected from the group consisting of a solid acid catalyst, a heteropolyacid, a zeolite, a titanium dioxide, an alumina, and combinations of the same.

4. The method of claim 1, wherein the hydration reactor is selected from a CSTR, a tubular reactor, a vessel-type reactor, and combinations of the same.

5. The method of claim 1, wherein the hydrated oil stream comprises a decreased amount of olefins relative to the pressurized liquid product.

6. The method of claim 1, wherein the desulfurized upgraded oil comprises a decreased amount of sulfur relative to the heated oil feed.

7. The method of claim 1, wherein the feed oil is selected from the group comprising petroleum, coal liquid, and biomaterials.

8. A method for sulfur removal, the method comprising the steps of:

introducing a mixed stream to a supercritical water reactor, wherein the mixed stream comprises supercritical water and hydrocarbons, wherein the mixed stream comprises a greater amount of water than hydrocarbons by volume as measured at standard temperature and pressure (SATP);

allowing conversion reactions to occur in the supercritical water reactor to produce a reactor effluent;

introducing the reactor effluent to a cooler;

reducing the temperature of the reactor effluent in the cooler to produce a cooled effluent;

introducing the cooled effluent to a hydration reactor;

processing the cooled effluent in the hydration reactor to produce a hydrated effluent, wherein the hydration reactor is at a temperature between 300 deg C. and 370 deg C. and a pressure of greater than the critical pressure of water such that water is near-critical in the liquid phase;

introducing the hydrated effluent to a cooling device;

reducing the temperature of the hydrated effluent in the cooling device to produce a cooled treated effluent;

introducing the cooled treated effluent to a depressurizing device;

reducing the pressure of the cooled treated effluent in the depressurizing device to produce a depressurized effluent;

introducing the depressurized effluent to a gas-liquid separator;

separating the depressurized effluent in the gas-liquid separator to produce a vapor product and a liquid product;

feeding the liquid product to an oil-water separator;

separating the liquid product in the oil-water separator to produce an upgraded oil and an oxygenated water, wherein the oxygenated water comprises oxygenates;

introducing the upgraded oil to a hydrotreater unit; and processing the upgraded oil in the hydrotreater unit to produce a desulfurized upgraded oil.

9. The method of claim 8, further comprising the steps of:

introducing the oxygenated water to an oxygenates separator; and separating the oxygenated water in the oxygenates separator to produce a separated water and an oxygenates stream, wherein the oxygenates stream comprises a concentration of oxygenates.

10. The method of claim 9, further comprising the steps of:

mixing the oxygenates stream and a water feed in a feed mixer to produce an oxygenated water feed, wherein the oxygenated water feed comprises oxygenates;

introducing oxygenated water feed to a water pump;

increasing the pressure of the oxygenated water feed to produce a pressurized water stream;

introducing the pressurized water stream to a decomposition reactor, wherein the temperature in the decomposition reactor is between 550 deg C. and 600 deg C.;

facilitating the decomposition of oxygenates in the pressurized water stream to produce a heated water feed, wherein the decomposition of oxygenates hydrates the oxygenates to olefins and converts the olefins oxygenates to non-olefinic compounds, wherein the non-olefinic compounds are selected from the group consisting of aromatics, paraffins, and combinations of the same; and mixing the heated water feed with a feed oil to produce the mixed stream.

11. The method of claim 10, wherein the residence time in the decomposition reactor is at least 10 seconds.

12. The method of claim 9, wherein the concentration of oxygenates in oxygenates stream is at least 10 wt %.

13. The method of claim 8, wherein the feed oil is selected from the group comprising petroleum, coal liquid, and biomaterials.

* * * * *